US008227720B2

(12) United States Patent
Tsuchiya et al.

(10) Patent No.: US 8,227,720 B2
(45) Date of Patent: Jul. 24, 2012

(54) VACUUM SWITCH AND VACUUM SWITCHGEAR

(75) Inventors: Kenji Tsuchiya, Hitachi (JP); Takashi Sato, Mito (JP); Miki Yamazaki, Kashiwa (JP); Masato Kobayashi, Hitachi (JP); Hiroyuki Ozawa, Konosu (JP)

(73) Assignee: Hitachi, Ltd., Tokyo (JP)

( * ) Notice: Subject to any disclaimer, the term of this patent is extended or adjusted under 35 U.S.C. 154(b) by 480 days.

(21) Appl. No.: 12/494,674

(22) Filed: Jun. 30, 2009

(65) Prior Publication Data

US 2010/0000973 A1 Jan. 7, 2010

(30) Foreign Application Priority Data

Jun. 30, 2008 (JP) ..... 2008-169775
Aug. 6, 2008 (JP) ..... 2008-202605

(51) Int. Cl.
*H01H 33/66* (2006.01)

(52) U.S. Cl. ..... 218/136; 218/134

(58) Field of Classification Search ..... 218/118–121, 218/134–140, 154, 155
See application file for complete search history.

(56) References Cited

U.S. PATENT DOCUMENTS

| | | | | |
|---|---|---|---|---|
| 6,308,857 | B1 | 10/2001 | Heimbach et al. | |
| 7,880,111 | B2 * | 2/2011 | Inoue et al. | 218/136 |
| 2009/0134125 | A1 | 5/2009 | Inoue et al. | |

FOREIGN PATENT DOCUMENTS

| | | | |
|---|---|---|---|
| CN | 1269591 | A | 10/2000 |
| EP | 1059650 | | 12/2000 |
| EP | 1041593 | B1 | 9/2004 |
| JP | 2001-338557 | | 12/2001 |
| JP | 2005-197061 | | 7/2005 |
| WO | WO 2007/116661 | | 10/2007 |

OTHER PUBLICATIONS

Extended European Search Report in European Application No. 09008572.1-2214 dated Oct. 23, 2009.
Chinese Office Action dated Nov. 1, 2011, issued in corresponding Chinese Patent Application No. 2009101509732.
Notice of Opposition dated Jan. 31, 2012, issued in corresponding European Patent Application No. 09008572.1.

* cited by examiner

*Primary Examiner* — Renee S Luebke
*Assistant Examiner* — Marina Fishman
(74) *Attorney, Agent, or Firm* — Brundidge & Stanger, P.C.

(57) ABSTRACT

A vacuum switch has a fixed electrode, a movable electrode facing the fixed electrode, an insulating cylinder, end plates covering both axial ends of the insulating cylinder, a vacuum chamber internally accommodating the fixed electrode and the movable electrode, and a solid isolation resin molded on the outside of the vacuum chamber, first coil springs, each of which is disposed around the outer circumference of one end plate while touching the end plate and an end face of the insulating cylinder, and second coil springs, each of which is united to one of the first springs and disposed around the outer circumference of the insulating cylinder so as to cover the angular part of the end face of the insulating cylinder, and the end plates, the end faces of the insulating cylinder, and the first and second coil springs are electrically connected.

14 Claims, 13 Drawing Sheets

VACUUM SWITCH AND VACUUM SWITCHGEAR

CLAIM OF PRIORITY

The present application claims priority from Japanese patent application serial No. 2008-169775, filed on Jun. 30, 2008, and Japanese patent application serial No. 2008-202605, filed on Aug. 6, 2008, the contents of which are hereby incorporated by reference into this application.

BACKGROUND OF THE INVENTION

1. Field of the Invention

The present invention relates to a vacuum switch and a vacuum switchgear, and more particularly relates to a vacuum switch and a vacuum switchgear that are suitable when the circumference of a vacuum chamber accommodating the switch unit is isolation-molded.

2. Description of Related Art

A vacuum switch is a switch that utilizing high-vacuum isolation performance; a compact, SF6 gasless switch can be achieved.

Some vacuum switches have isolation performance improved by not only vacuum insulation but also by the use of a double layered isolating structure in which the circumference of the switch chamber is covered with solid isolation resin.

When the circumference of the switch chamber of the vacuum switch is covered with solid isolation resin, however, an electric field is concentrated at the ends of an insulating cylinder constituting the switch chamber, causing dielectric breakdown to be likely to occur.

Accordingly, a vacuum switch in which the circumference of the switch chamber is covered with solid isolation resin and relief of electric field concentration at the ends of the insulating cylinder is considered is described in Patent Document 1.

Patent Document 1 discloses a vacuum switch in which electric field relieving shields, each of which is formed in a doughnut shape by connecting both ends of a spiral spring made of conductive metal or resin, are disposed at the ends of an insulating cylinder internally including a fixed electrode and a movable electrode to constitute a vacuum chamber and then these electric field relieving shields are covered by molding, so that electric field concentration at the ends of the isolating layer is relieved.

Patent Document 1: Japanese Patent Laid-open No. 2005-197061

SUMMARY OF THE INVENTION

However, the structure disclosed in Patent Document 1 is problematic in that because the doughnut-shaped electric field relieving shield disposed at each end of the insulating cylinder has a doughnut shape formed by connecting both ends of a single spiral spring, the angular part at the end of the insulating cylinder, at which an electric field is most concentrated, cannot be covered and thereby an electric field is concentrated on the angular part at the end of the insulating cylinder, which may lead to dielectric breakdown.

Accordingly, an object of the present invention is to provide a vacuum switch and a vacuum switchgear that prevents an electric field from concentrating on the angular part at each end of the insulating cylinder to suppress dielectric breakdown.

To achieve the above object, a vacuum switch of the present invention has a fixed electrode, a movable electrode facing the fixed electrode, an insulating cylinder, end plates covering both axial ends of the insulating cylinder, a vacuum chamber internally accommodating the fixed electrode and the movable electrode, and a solid isolation resin molded on the outside of the vacuum chamber, characterized in that, a first coil springs, each of which is disposed around the outer circumference of one end plate while touching the end plate and an end face of the insulating cylinder, and a second coil springs, each of which is united to one of the first springs and disposed around the outer circumference of the insulating cylinder so as to cover the angular part of the end face of the insulating cylinder, and the end plates, the end faces of the insulating cylinder, and the first and second coil springs are electrically connected.

To achieve the above object, a vacuum switchgear of the present invention has a vacuum chamber formed by hermetically connecting a fixed electrode end plate and a movable electrode end plate to both ends of an isolating cylinder, a fixed electrode lead and a movable electrode lead oppositely disposed in the vacuum chamber, a fixed electrode attached to an end of the fixed electrode lead, and a movable electrode attached to an end of the movable electrode lead, characterized in that, the vacuum switchgear has an external end shield disposed around the outer circumference of a connection part between the isolating cylinder and the movable electrode end plate, a first fitting part disposed on the inner circumferential surface of the external end shield, and a second fitting part disposed on the electrode end plate for facing the first fitting part, and both of the first fitting part and the second fitting part are mutually fitted.

According to the vacuum switch and the vacuum switchgear of the present invention, the angular part at the end of the insulating cylinder can be covered, so an electric field is not concentrated on this part, dielectric breakdown is suppressed, and thereby isolation reliability is improved.

DETAILED DESCRIPTION OF THE PREFERRED EMBODIMENTS

A first embodiment of a vacuum switch according to the present invention will be described using FIGS. 1 to 5.

Figure 1:
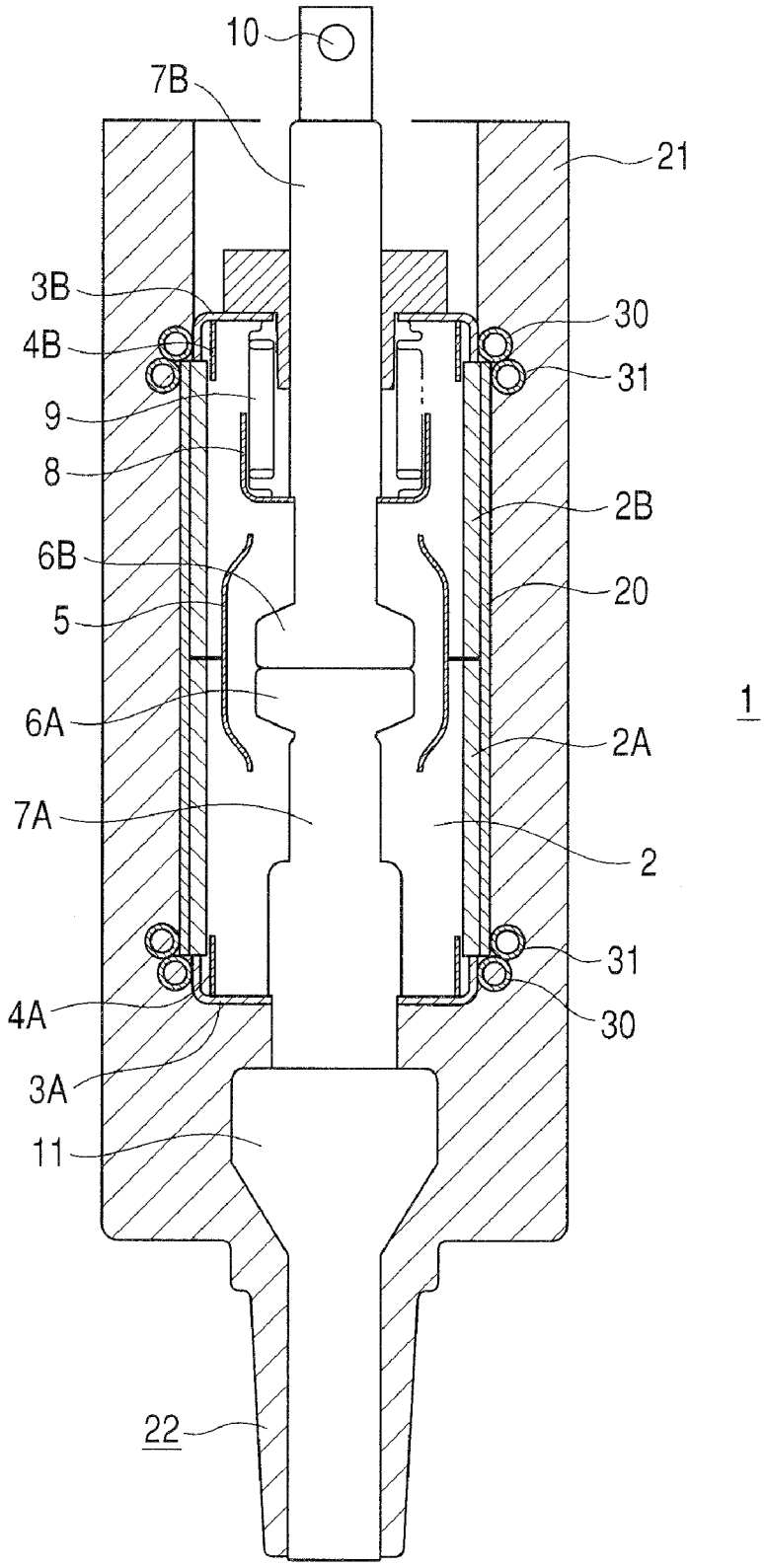
FIG. 1 is a cross sectional view of a vacuum switch showing a first embodiment in the present invention.

As shown in FIG. 1, the vacuum switch 1 in the first embodiment of the present invention substantially comprises a vacuum chamber 2, a fixed electrode 6A and a movable electrode 6B disposed in the vacuum chamber 2, and a solid isolation resin 21 covering the circumference of the vacuum chamber 2.

The vacuum chamber 2 comprises a fixed-side ceramic insulating cylinder 2A, a movable-side ceramic insulating cylinder 2B linked to the fixed-side ceramic insulating cylinder 2A, a fixed-side end plate 3A linked to a fixed end of the fixed-side ceramic insulating cylinder 2A in its axial direction, the fixed-side end plate 3A being metallic and thinner than the insulating cylinders 2A and 2B, and a movable-side end plate 3B linked to a movable end of the movable-side ceramic insulating cylinder 2B, the movable-side end plate 3B being metallic; the interior of the vacuum chamber 2 is maintained in a high vacuum state. Metalizing, which is well suitable to metal in brazing, is applied to brazing faces between both insulating cylinders 2A and 2B and both end plates 3A and 3B to perform brazing on both metallic end plates 3A and 3B.

Inside the vacuum chamber 2, the fixed electrode 6A and the movable electrode 6B, which moves in the axial direction while facing the fixed electrode 6A, are disposed; the fixed electrode 6A is held at the distal end of a fixed-side electrode rod 7A, which passes through the fixed-side end plate 3A in the vacuum chamber 2 in the axial direction, and the movable electrode 6B is held at the distal end of a movable-side electrode 7B, which passes through the movable-side end plate 3B in the vacuum chamber 2 in the axial direction. A movable-side conductor 10 is connected at an end of the movable-side electrode rod 7B in the axial direction that is opposite to the end at which the movable electrode 6B is held; the movable-side conductor 10 is electrically connected to one end of a bus side or load side. A fixed-side conductor 11, the circumference of which is covered with solid isolation resin 22, is connected at an end of the fixed-side electrode rod 7A that is opposite to the end at which the fixed electrode 6A is held; the fixed-side conductor 11 is electrically connected to the other end of the bus side or load side. The movable-side electrode rod 7B is vertically moved in the axial direction in the drawing by an operating unit (not shown) to move the movable electrode 6B, achieving closed, open, and disconnecting positions between the movable electrode 6B and the fixed electrode 6A.

A bellows 9, which is supported by the movable-side end plate 3B, is disposed around the movable-side electrode rod 7B so that even when the movable-side electrode rod 7B moves upward and downward in the axial direction, the vacuum state in the vacuum chamber 2 is maintained. A bellows shield 8, which is supported by the movable-side electrode rod 7B, is disposed around the bellows 9 to prevent adhesion of metallic particles, which scatter due to the arc generated between the electrodes during open and close operations, to the bellows 9 and to relieve electric field concentration on the ends of the bellows 9. An arc shield 5, which is supported by the ceramics insulating cylinder, is disposed around the fixed electrode and movable 6A and 6B to prevent adhesion of fine metallic particles, which scatter due to the arc generated from, for example, open and close operations, to the inner surface of the vacuum chamber 2 and thereby prevent isolation performance from being lowered. A fixed-side electric field relieving shield 4A and a movable-side electric field relieving shield 4B, which are supported by the fixed-side and movable-side end plates 3A and 3B, are disposed near the inner surfaces of the ends of the metalized surfaces of the fixed-side and movable-side ceramic insulating cylinders 2A and 2B to relieve electric fields, which would otherwise concentrate on the ends of the metalized surfaces of the fixed-side and movable-side ceramic insulating cylinders 2A and 2B, in the vacuum chamber 2.

The outside of the vacuum chamber 2 is covered with the solid isolation resin 21 such as epoxy. A buffer layer 20 is disposed on the outer circumferences of the fixed-side and movable-side ceramic insulating cylinders 2A and 2B to relieve stress concentration caused due to a difference in thermal shrinkage ratios between the ceramic and the solid isolation resin 21, the buffer layer 20 being a material that has a thermal shrinkage ratio between the ceramic and the resin used for solid isolation and is softer than the ceramic and the resin used for solid isolation.

In this embodiment, to relieve electric field concentration on the external angular metalized parts, which are brazing parts between the fixed-side ceramic insulating cylinder 2A and fixed-side end plate 3A and between the movable-side ceramic insulating cylinder 2B and movable-side end plate 3B, a first coil spring 30 and a second coil spring 31, which are metallic, are disposed to cover these angular parts.

How the first coil spring 30 and second coil spring 31 are disposed will be described using FIGS. 2 to 5.

Figure 2:
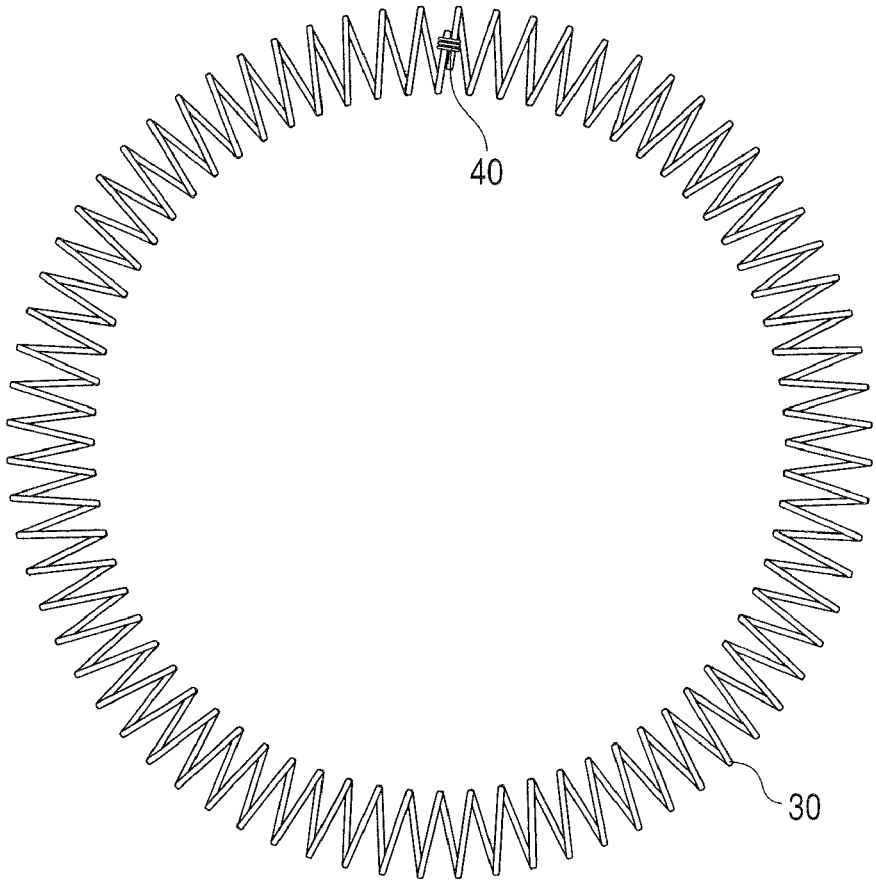
FIG. 2 shows a coil spring used in the vacuum switch of the first embodiment in the present invention shown in FIG. 1.
Figure 3:
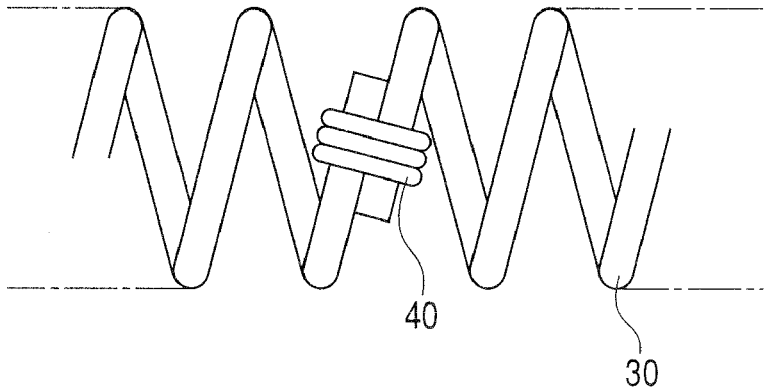
FIG. 3 is a magnified view showing a united state at the terminal ends of the coil spring shown in FIG. 2.
Figure 4:
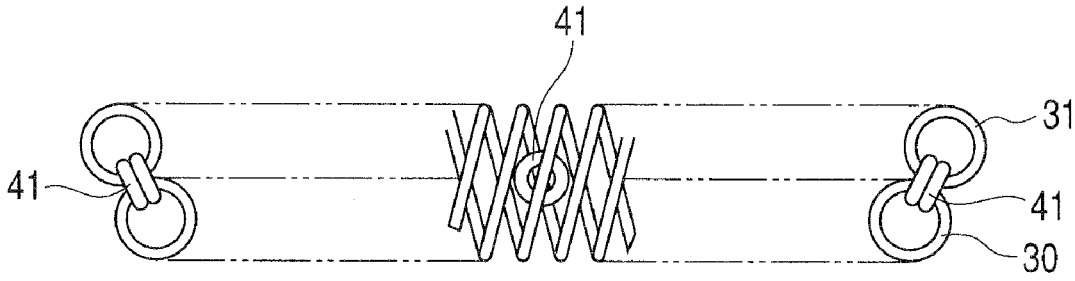
FIG. 4 shows a state in which two coils springs used in the vacuum switch of the first embodiment in the present invention are united, the two coil springs having different circumferential lengths.

As shown in FIG. 2, the first coil spring 30 is formed in a doughnut shape by using a metal wire member that is wound in a spiral shape. The ends of the first coil spring 30 are united by winding a uniting line 40 as shown in FIG. 3. FIG. 4 illustrates how the first coil spring 30 is united to the second coil spring 31, which has a larger radius than the first coil spring 30 in the natural state. A strong unity is achieved by performing uniting at three or four positions as shown in FIG. 4.

Here, the circumferential length of the first coil spring 30, which is stipulated on the drawing sheet of FIG. 2, is shorter than the length of the external circumference of the end plate in the natural state, and the circumferential length of the second coil spring 31 is shorter than the length of the external circumference of the ceramics insulating cylinder 2A, 2B in the natural state.

Figure 5:
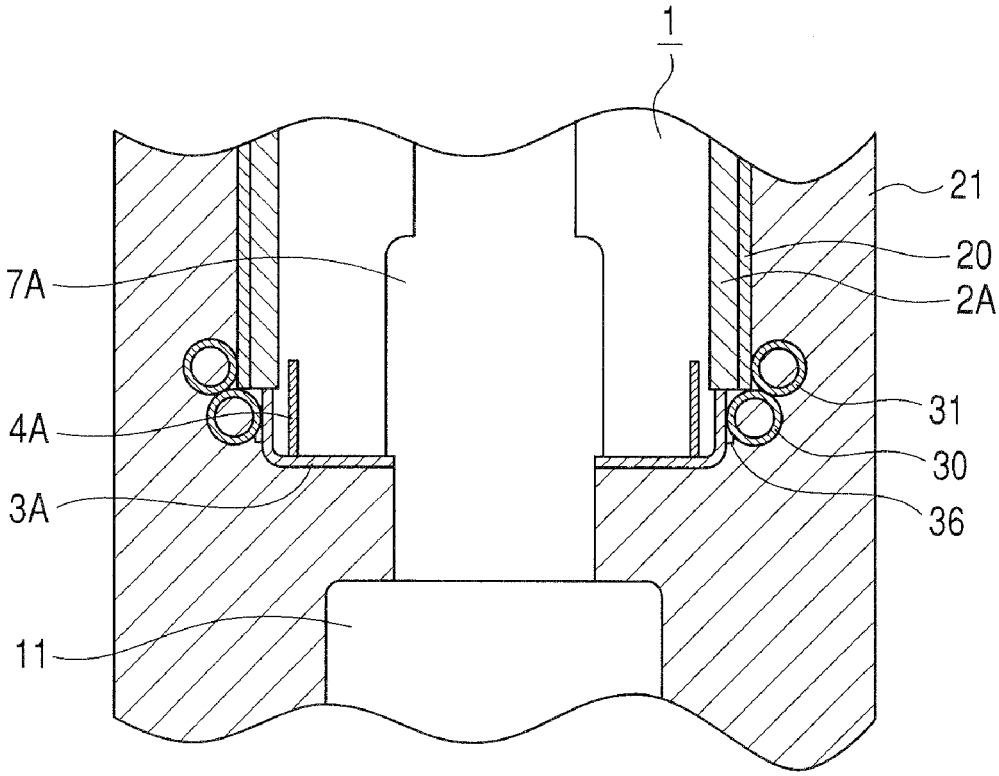
FIG. 5 is a partially magnified cross section of the fixed-side ceramic insulating cylinder in the vacuum switch of the first embodiment in the present invention shown in FIG. 1.

Next, how the first coil spring 30 and second coil spring 31, which have been united, are attached will be described using FIG. 5. FIG. 5 is a magnified view of the end of the fixed-side ceramic insulating cylinder 2A in the vacuum switch of the first embodiment shown in FIG. 1.

In a state in which, before solid isolation is performed, the buffer layer 20 is disposed around the outer circumference of the fixed-side ceramic insulating cylinder 2A, the first coil spring 30 and second coil spring 31 are placed on the fixed-side end plate 3A from the fixed side by being pressed, the second coil spring 31 with a larger radius in the natural state being first placed; since the circumferential length of the second coil spring 31 is shorter than the length of the external circumference of the fixed-side ceramics insulating cylinder 2A in the natural state and the circumferential length of the first coil spring 30 is shorter than the length of the external circumference of the fixed-side end plate 3A in the natural state, when the second coil spring 31 is positioned on the outer circumference of the fixed-side ceramic insulating cylinder 2A and the first coil spring 30 is positioned on the outer circumference of the fixed-side end plate 3A, the first coil spring 30 and second coil spring 31 are expanded.

Finally, the first coil spring 30 abuts against the outer circumference of the fixed-side end plate 3A and against the metalized surface of the end of the fixed-side ceramic insulating cylinder 2A, and stops at a position at which the angular part of the fixed-side ceramic insulating cylinder 2A is covered with the first coil spring 30 and second coil spring 31. At that time, the first coil spring 30 and second coil spring 31 are fixed in a state in which they are expanded from their natural lengths, so shrinking forces act and thereby the first coil spring 30 and second coil spring 31 do not move easily from their positions, at which they are fixed by applying a conductive glue 36. Accordingly, the fixed-side end plate 3A, the first coil spring 30, and the second coil spring 31 united to the first coil spring 30 are mutually electrically connected.

The same procedure is also executed on the movable side to dispose and fix the first coil spring 30 and second coil spring 31; after the first coil spring 30 and second coil spring 31 have been fixed, molding is performed using the solid isolation resin 21.

According to the vacuum switch in the embodiment described above, the first coil spring 30 abuts against the outer circumference of the fixed-side end plate 3A and against the metalized surface of the end of the fixed-side ceramic insulating cylinder 2A, and the angular part of the fixed-side ceramic insulating cylinder 2A, which is an area on which an electric field is concentrated, is covered with the first coil spring 30 and the second coil spring 31, to which the first coil spring 30 is united.

Accordingly, the fixed-side end plate 3A, the potential of which is equal to the operating voltage, the first coil spring 30 and second coil spring 31, which cover the angular part of the fixed-side ceramic insulating cylinder 2A, and the metalized surface of the fixed-side ceramic insulating cylinder 2A are mutually electrically connected, making their potentials equal to the operating voltage.

Accordingly, it becomes possible to relieve electric field concentration on the angular part of the end of the fixed-side ceramic insulating cylinder 2A, and thereby a partial discharge is less likely to occur even when a high voltage is applied, preventing dielectric breakdown. In addition, since the first coil spring 30 and second coil spring 31, which are metal wire members in a spiral shape, have much clearance and do not have continuous narrow clearance, a flow of resin is not impeded during molding by use of the solid isolation resin 21, preventing voids from being easily formed and making it possible to prevent the isolation performance from being lowered.

Since the coil springs used in this embodiment are metallic, they have high heat resistance and can withstand higher temperatures during molding than when, for example, conductive resin is disposed.

Next, a vacuum switch of a second embodiment in the present invention will be described using FIG. 6.

Figure 6:
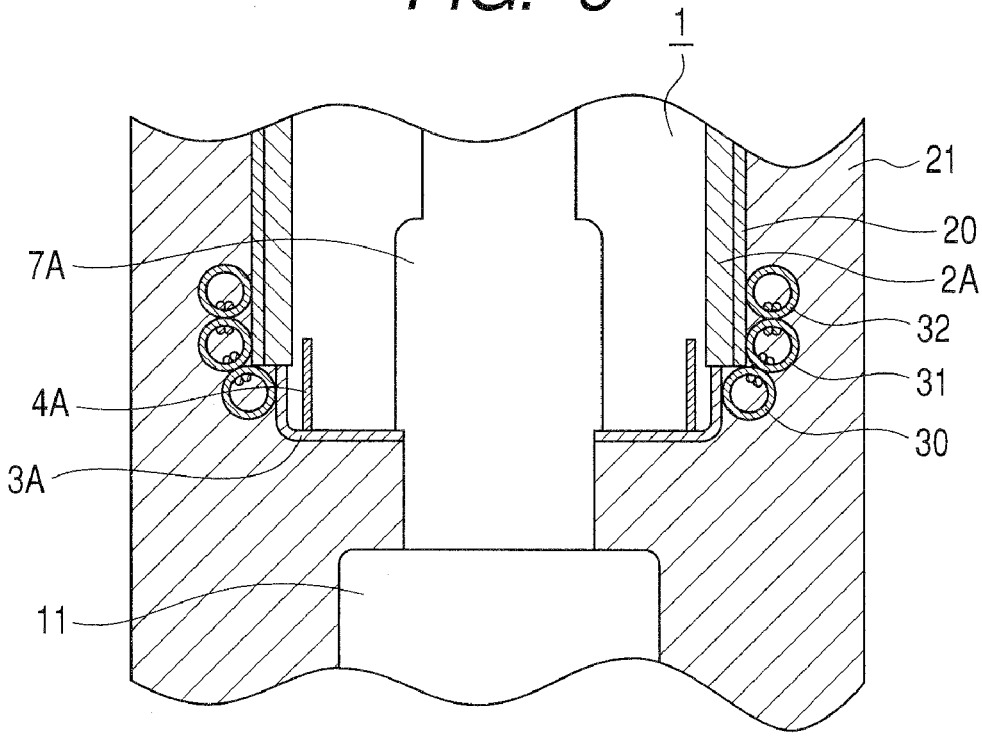
FIG. 6 is a magnified partial cross sectional view of a fixed-side ceramic insulating cylinder in the vacuum switch showing a second embodiment of the present invention.

In the second embodiment shown in FIG. 6, in addition to the first coil spring 30 and second coil spring 31 used in the first embodiment, a third coil spring 32, which is metallic, is disposed on the second coil spring 31, and the second coil spring 31 and third coil spring 32 are united as in FIG. 4. Since the first coil spring 30 is electrically connected to the fixed-side end plate 3A, the first coil spring 30, the second coil spring 31, the third coil spring 32, the fixed-side end plate 3A, and the metalized surface of the end of the fixed-side ceramic insulating cylinder 2A are mutually electrically connected.

Thus, the density of isoelectric lines can be made lower than in the first embodiment by expanding the distribution of isoelectric lines on the metalized surface of the end of the fixed-side ceramic insulating cylinder 2A. Then, electric field concentration can be further relieved as compared with the first embodiment.

Although the fixed side has been used as an example, the third coil spring 32 can also be united to the second coil spring 31 on the movable side in the same way to achieve the above effect.

A vacuum switch of a third embodiment of the present invention will be described using FIG. 7.

Figure 7:
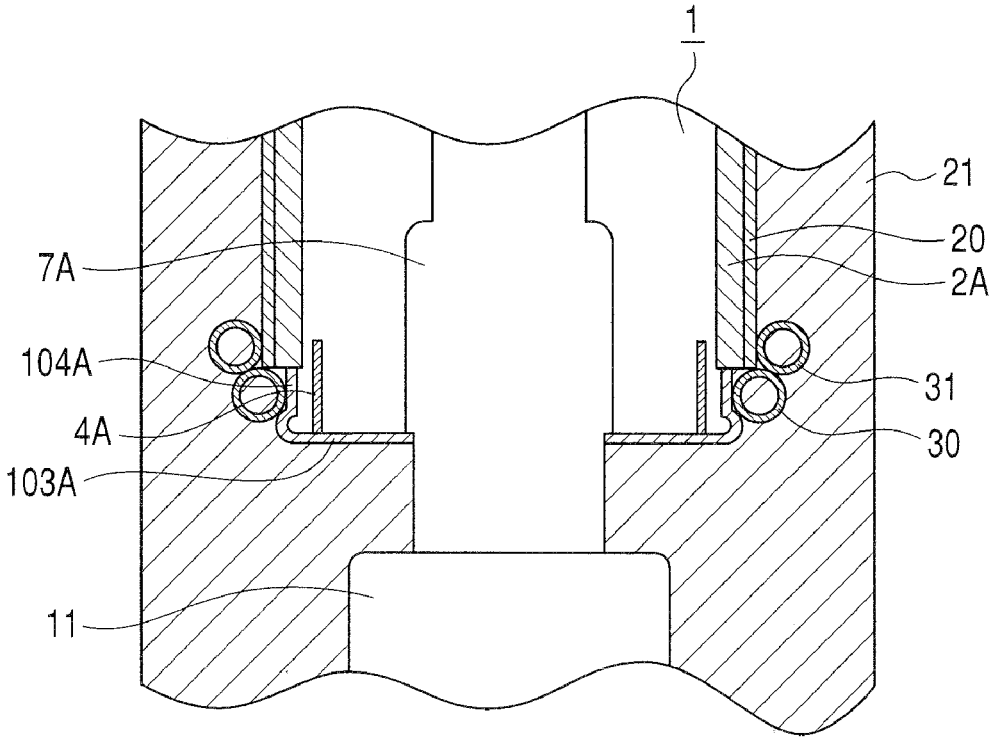
FIG. 7 is a magnified partial cross sectional view of a fixed-side ceramic insulating cylinder in the vacuum switch showing a third embodiment of the present invention.

In the vacuum switch of the third embodiment shown in FIG. 7, a fixed-side end plate 103A having a concave part 104A is used instead of the fixed-side end plate 3A in the vacuum switch 1 described in the first embodiment.

That is, in the fixed-side end plate 103A, the concave part 104A having an inward recess is formed near a linkage with the fixed-side ceramic insulating cylinder 2A; the first coil spring 30 is disposed in the concave part 104A.

The axial width of the concave part 104A is preferably equal to or smaller than the axial thickness of the first coil spring 30, and the concave part 104A is preferably deep enough to accept the first coil spring 30.

In this embodiment, not only the same effect as in the first embodiment described above is obtained, but also the first coil spring 30 can be fixedly fitted to the concave part 104A formed on the fixed-side end plate 103A, securely fixing the first coil spring 30.

Although only the fixed side has been described here, the first coil spring 30 can also be securely fixed by forming a similar concave on a movable-side end plate 103B.

A vacuum switch of a fourth embodiment of the present invention will be described using FIG. 8.

Figure 8:
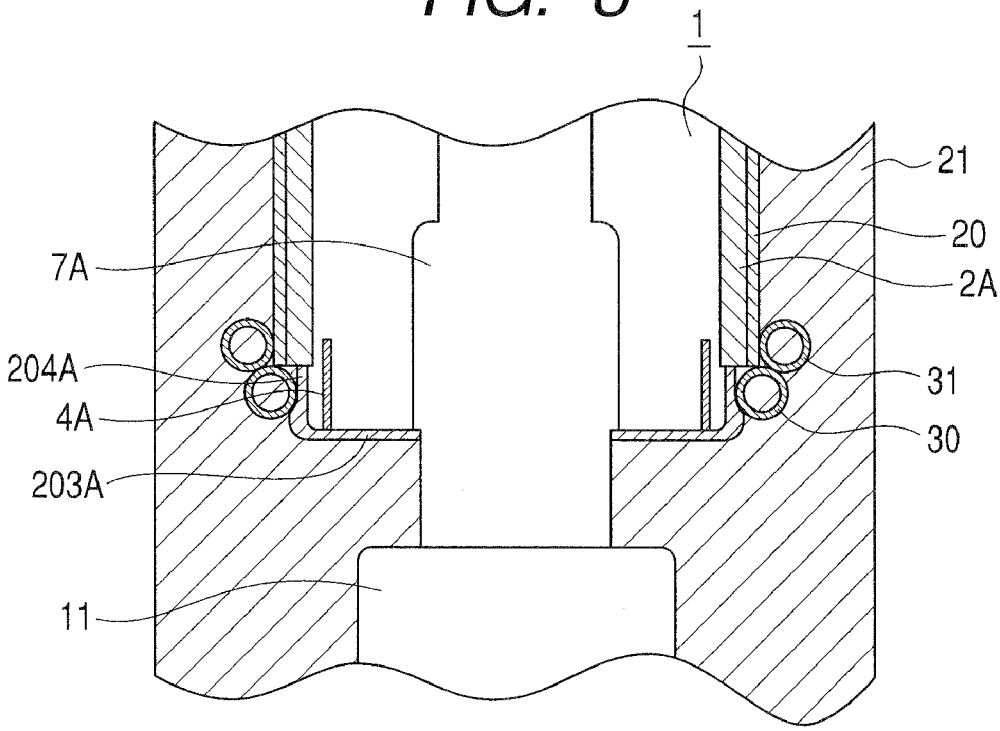
FIG. 8 is a magnified partial cross sectional view of a fixed-side ceramic insulating cylinder in the vacuum switch showing a fourth embodiment of the present invention.

In the vacuum switch of the fourth embodiment shown in FIG. 8, a fixed-side end plate 203A partially having a thin part 204A is used instead of the fixed-side end plate 103A described in the third embodiment.

That is, in the fixed-side end plate 203A, the thin part 204A, which is thinner than the other fixed-side end plate 203, is used instead of the part in which the concave part 104A is formed in the third embodiment; the first coil spring 30 is disposed on the thin part 204A.

The axial width of the thin part 204A is preferably equal to or smaller than the axial thickness of the first coil spring 30 because the first coil spring 30 is disposed thereon.

In this embodiment, not only the same effect as in the first embodiment described above is obtained, but also the first coil spring 30 can be fixedly fitted to the thin part 204A formed on the fixed-side end plate 203A, securely fixing the first coil spring 30.

Although only the fixed side has been described here, the first coil spring 30 can also be securely fixed by forming a similar thin part on a movable-side end plate 203B.

A vacuum switch of a fifth embodiment of the present invention will be described using FIG. 9.

Figure 9:
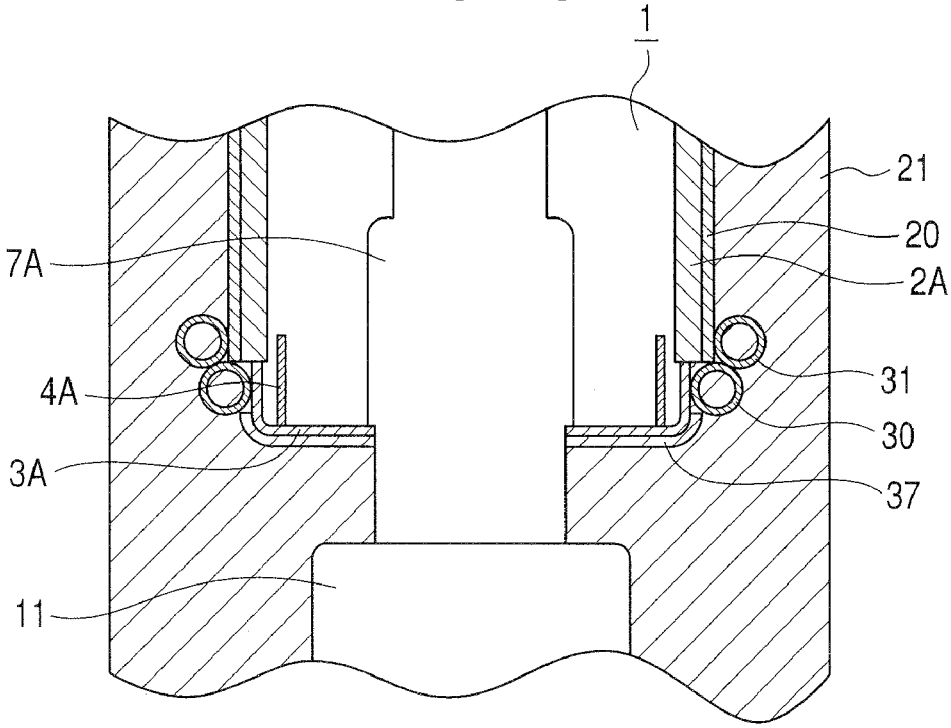
FIG. 9 is a magnified partial cross sectional view of a fixed-side ceramic insulating cylinder in the vacuum switch showing a fifth embodiment of the present invention.

In the vacuum switch of the fifth embodiment shown in FIG. 9, a spring guide 37 is disposed outside the fixed-side end plate 3A in the first embodiment so that the spring guide 37 does not touch the metalized surface of the fixed-side ceramic insulating cylinder 2A but overlaps it at other parts, and the first coil spring 30 is disposed on a part where the spring guide 37 does not overlap the fixed-side end plate 3A. The first coil spring 30 is hooked on the end of the outer circumference of the spring guide 37 and firmly fixed between the spring guide 37 and the metalized surface of the fixed-side ceramic insulating cylinder 2A. When a spring guide 37 that is different in the length over which the spring guide 37 covers the fixed-side end plate 3A in the axial direction and in the thickness at a point where the spring guide 37 touches the first coil spring 30 is used, the extent to which the first coil spring 30 is hooked can be adjusted.

That is, when the length over which the spring guide 37 covers the fixed-side end plate 3A in the axial direction is equal to or smaller than the axial length of the first coil spring 30 and the thickness of the spring guide 37 at a point where the spring guide 37 touches the first coil spring 30 is increased, the first coil spring 30 can be firmly fixed. The distance between the fixed-side end plate 3A and the spring guide 37, by which the first coil spring 30 is hooked, is preferably equal to or smaller than the axial thickness of the first coil spring 30.

Figure 10:
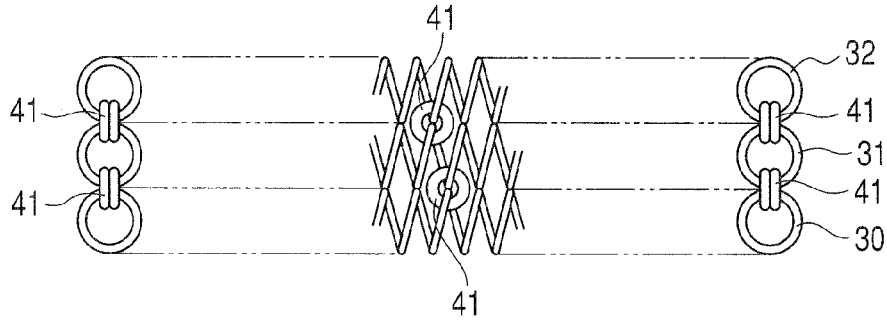
FIG. 10 shows a coil spring used in the vacuum switch of a sixth embodiment in the present invention, in which three coil springs having the same circumferential length are united.

A coil spring used in a vacuum switch of a sixth embodiment in the present invention will be described using FIG. 10.

In the second embodiment described above, the circumferential lengths of the first coil spring 30 to the third coil spring 32 are different. In this embodiment shown in FIG. 10, however, the first coil spring 30 to the third coil spring 32 have the same circumferential length. Accordingly, the first coil spring 30 to the third coil spring 32 do not need to be distinguished; it suffices to manufacture only one type of coil spring, reducing manufacturing costs. In addition, when coil springs are attached, there is no restriction as to which of the first coil spring 30 and third coil spring 32 must be placed first, improving the ease of assembly.

Although a case in which three coil springs are used has been described in this embodiment, even when two coil springs are used, the same effect can be achieved by making the lengths of their circumferences equal.

Figure 11:
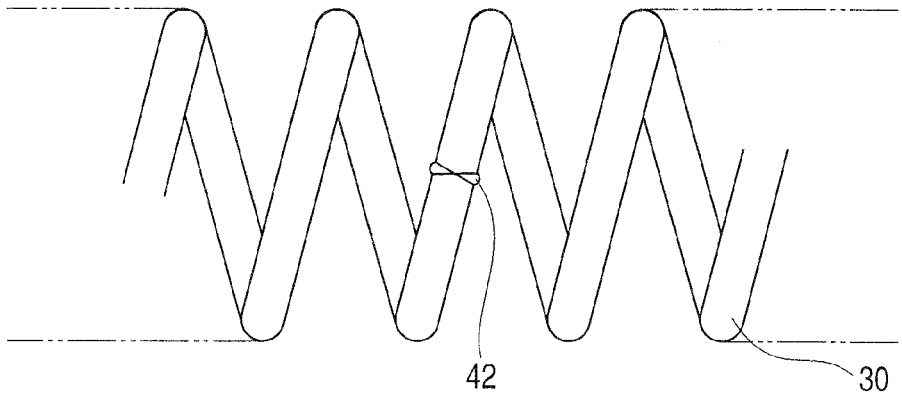
FIG. 11 is a partially magnified view showing a coil spring used in the vacuum switch of a seventh embodiment in the present invention.

A coil spring used in a vacuum switch of a seventh embodiment in the present invention will be described using FIG. 11.

Although the coil springs are united by uniting their ends with the uniting line 40 in the first to sixth embodiments, the ends of the first coil spring 30 are made to face each other and welded to unite them in this embodiment. Since the ends are made to face each other and welded, the terminal ends of the coil spring are eliminated from the united point 42 and the uniting line 40 does not need to be used, so there are no parts where electric field concentration is likely to occur, such as the ends of the coil spring and the ends of the uniting line, enabling electric field concentration to be relieved.

Although the first coil spring 30 has been used as an example in the above description, it will be appreciated that application to the second and third coil springs 31 and 32 are also possible.

A coil spring used in a vacuum switch of an eighth embodiment in the present invention will be described using FIG. 12.

Figure 12:
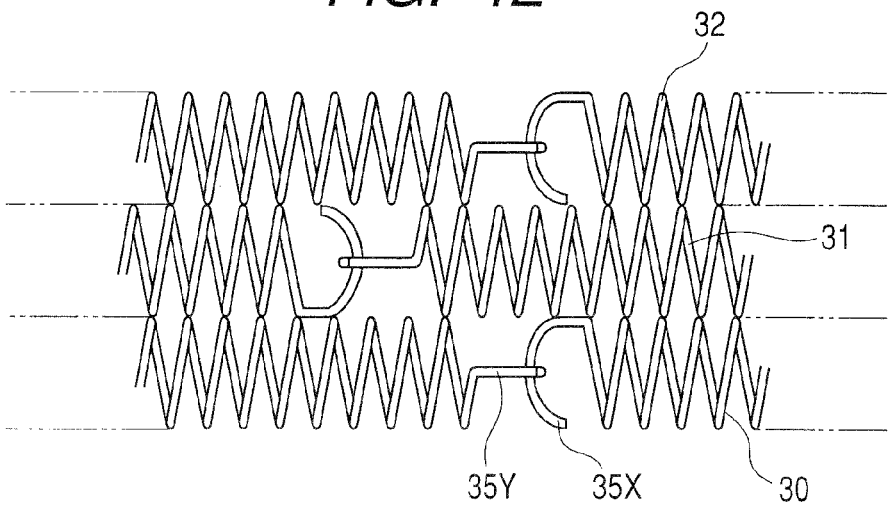
FIG. 12 is a partially magnified view showing a coil spring used in the vacuum switch of an eighth embodiment of the present invention, in which three coil springs are united.

In the coil spring used in the vacuum switch of the eighth embodiment shown in FIG. 12, hooks 35X and 35Y are formed at the ends of the first coil spring 30 and uniting is carried out through the hooks 35X and 35Y. The first coil spring 30 to the third coil spring 32 are united at different positions.

According to this embodiment, since the ends are united by hooking the coil spring, the ease of assembly is improved. Since a plurality of coil springs are united at different positions, parts, other than the ends, of the other coil springs are positioned near the ends of the hooks, where electric field concentration is likely to occur, relieving the electric field concentration at the ends of the hooks.

An embodiment in which the vacuum switch 1 described in the first embodiment is mounted on a vacuum switchgear will be described using FIG. 13.

Figure 13:
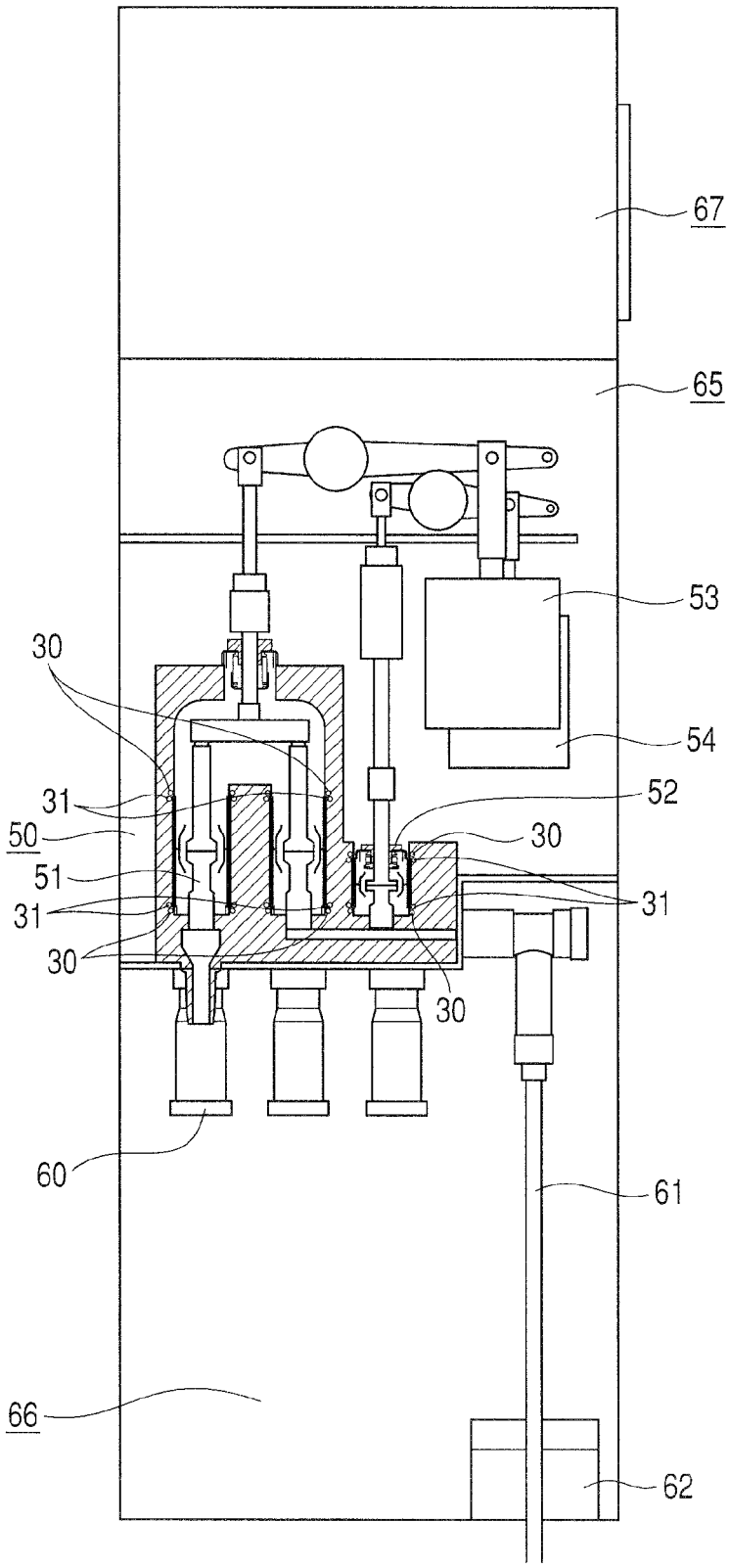
FIG. 13 is a partial cross sectional view of a vacuum switchgear in which the vacuum switch in the first embodiment of the present invention is mounted.

As shown in FIG. 13, a vacuum switchgear 66 in this embodiment mainly comprises a switch unit 50, operating mechanisms 53 and 54 for operating the switch 51 in the switch unit 50, a three-phase bus 60 for supplying electric power to the switch unit 50, a load cable 61, which is connected to the switch unit 50 and supplies electric power to a load side, a current transformer 62 connected to the load cable 61, and a metering room 67 disposed at the top in the vacuum switchgear 66.

The switch unit 50 comprises a vacuum switch 51 with a double-break structure in which two contacts for a break and disconnection are accommodated in a single vacuum chamber, an earthing switch 52 connected to the load side through the vacuum switch 51 and a conductor, and the solid isolation resin 21 molded to integrate these members. The vacuum switch 51 and earthing switch 52 each include the first and second coil springs 30 and 31. The operating mechanism 53 is an operating mechanism for breaking and disconnecting parts, and the operating mechanism 54 is an operating mechanism for the earthing switch.

According to this embodiment, since the switch unit 50 having isolation performance improved by disposing the first coil spring 30 and second coil spring 31 is used, a vacuum switchgear having high isolation reliability can be provided.

It will be appreciated that the vacuum switchgear according to this embodiment can use any of the structures in the embodiments described above.

Although only a case in which two or three coil springs are united has been descried in each embodiment described above, a case in which even four or more coil springs are united is also of course applicable. In this case, the spacing between isoelectric lines at the angular part of the insulating cylinder can be expanded, so the electric field concentration on the angular part of the insulating cylinder can be relieved.

Figure 14:
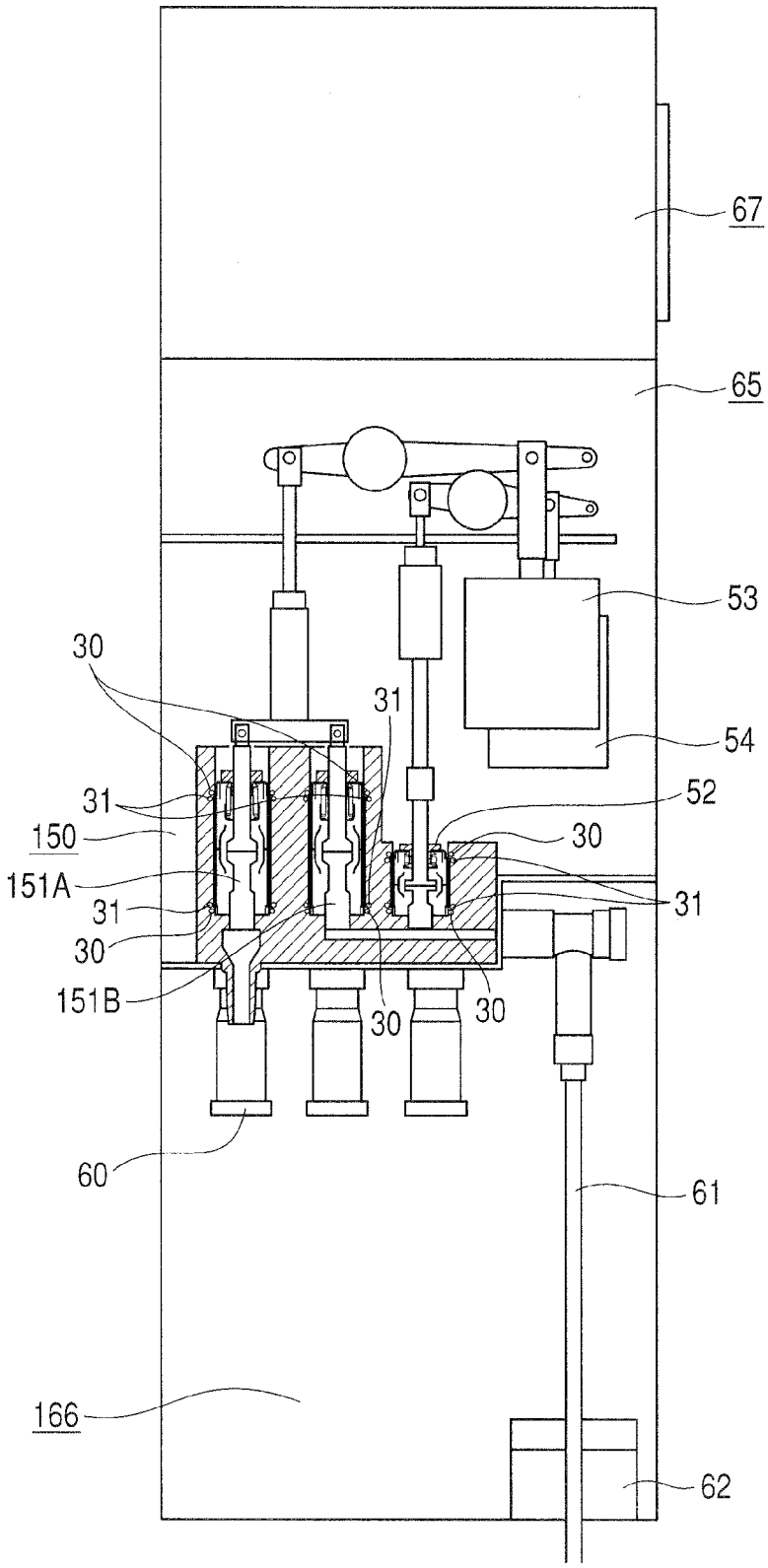
FIG. 14 is a partial cross sectional view of another vacuum switchgear in which the vacuum switch in the first embodiment of the present invention is mounted.

Next, another vacuum switchgear of an embodiment in the present invention, which is different from the above embodiment, in which the vacuum switch 1 described in the first embodiment is mounted in the vacuum switchgear, will be described using FIG. 14. A vacuum switchgear 166 according to this embodiment has the same structure as in the above embodiment described using FIG. 13, excluding the switch unit 150, so a detailed description will be omitted here.

The switch unit 150 comprises vacuum switches 151A and 151B forming a double-break structure in which two contacts for a break and disconnection are accommodated in different vacuum chambers, an earthing switch 52 connected to the load side through the vacuum switches 151A and 151B and a conductor, and the solid isolation resin 21 for integrally molding these members. The vacuum switches 151A and 151B and earthing switch 52 each include the first and second coil springs 30 and 31 for their switches.

The switch unit 150 may have a vacuum chamber for each contact in a double-break structure as in this embodiment, for example, which is advantageous in that the degree of flexibility in manufacturing is increased.

In this embodiment as well, the switch unit 50, in which the first coil spring 30 and second coil spring 31 are disposed to improve isolation performance, is used as in the embodiment of the vacuum switchgear described above, so a vacuum switchgear having high isolation reliability can be provided.

It will be appreciated that the vacuum switchgear according to this embodiment can also use any of the structures in the embodiments described above, as in the embodiment of the vacuum switchgear described above.

Although only a case in which two or three coil springs are united has been descried in each embodiment described above, a case in which even four or more coil springs are united is also of course applicable. In this case, the spacing between isoelectric lines at the angular part of the insulating cylinder can be expanded, so the electric field concentration on the angular part of the insulating cylinder can be relieved.

A vacuum switchgear according to a ninth embodiment of the present invention will be described with reference to FIGS. 15 to 20.

Figure 15:
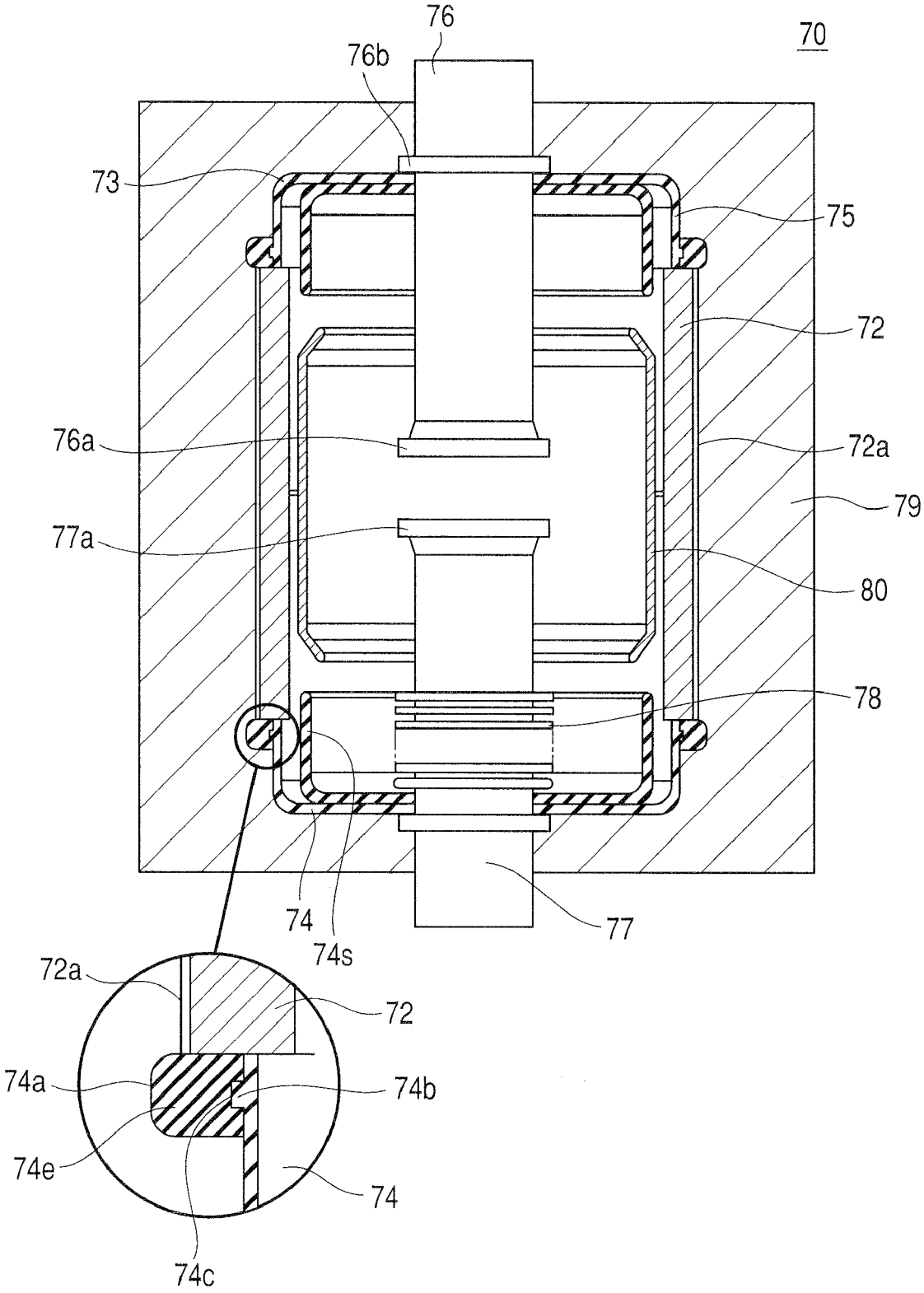
FIG. 15 is a cross sectional view of a vacuum switch of a vacuum switchgear showing a ninth embodiment in the present invention.

FIG. 15 is a structural diagram of the vacuum switchgear 70 according to the ninth embodiment of the present invention.

In FIG. 15, the vacuum chamber 75 is formed by including the substantially cylindrical isolating cylinder 72, which is manufactured from an insulating material such as ceramic. The fixed electrode lead 76 and movable electrode lead 77 are oppositely disposed in the vacuum chamber 75. The fixed electrode 76*a* is attached to the internal end of the fixed electrode lead 76, and the movable electrode 77*a* is attached to the internal end of the movable electrode lead 77. The fixed electrode 76*a* and movable electrode 77*a* are manufactured from a superior electric conductor such as copper. The fixed electrode lead 76 is substantially rod-shaped, on which a flange 76*b* is formed; the flange 76*b* passes through the fixed electrode end plate 73, and the surface of one side of the flange 76*b* is fixed to the fixed electrode end plate 73.

The movable electrode lead 77 is substantially rod-shaped similarly, and disposed so that it passes through a hole formed in the movable electrode end plate 74. The movable electrode lead 77 has a bellows 78 disposed between it and the movable electrode end plate 74 as an expansion and contraction means. The movable electrode lead 77 is connected to the movable electrode end plate 74 through the bellows 78.

The movable electrode 77*a* makes and breaks a contact together with the fixed electrode 76*a* through a moving means (not shown). A hole is formed at the center of the fixed electrode end plate 73, and the fixed electrode lead 76 passes through the hole. A hole is also formed at the center of the movable electrode end plate 74, and the movable electrode lead 77 passes through the hole.

To hermetically seal both ends of the isolating cylinder 72 of the vacuum chamber 75, the fixed electrode end plate 73 and movable electrode end plate 74 are secured to the both ends of the isolating cylinder 72. When the electrodes 76*a* and 77*a* open or close, an arc vapor is generated, which contaminates the inner circumferential surface of the isolating cylinder 72. Accordingly, a central shield 80, which encloses the electrodes 76*a* and 77*a*, is secured inside the isolating cylinder 72. Silver brazing is used to fix these parts to the inner wall of the isolating cylinder 72. To prevent the resulting electric field concentration at the brazing part between the isolating cylinder 72 and movable electrode end plate 74, an internal end shield 74*s* is attached so that the brazing part between the isolating cylinder 72 and movable electrode end plate 74 is covered.

The movable electrode end plate 74 is made of, for example, stainless steel; its coefficient of linear expansion is $16.0\times10^{-6}$(1/K). The coefficient of linear expansion of the isolating cylinder 72 made of alumina or the like, which is fixedly joined to the movable electrode end plate 74, is $7.5\times10^{-6}$(1/K).

This difference in thermal physical value causes vastly different free expansion or contraction during a molding process in which heat is applied, generating thermal stress at an end of the brazing interface.

This embodiment prevents the generation of thermal stress by reducing the brazing area of members manufactured from materials having different coefficients of linear expansion. Since the coefficient of linear expansion of the isolating layer 79, which is 22 to $26\times10^{-6}$(1/K), is largely different from the coefficient of linear expansion of the isolating cylinder 72, it is necessary to prevent a crack from being generated in the isolating layer 79. Accordingly, a stress relieving layer 72*a* (made of silicone rubber or the like) is coated on the outer surface and ends of the isolating cylinder 72.

On the outside of the vacuum chamber 75 as well, electric field relief is required in the brazing part between the isolating cylinder 72 and movable electrode end plate 74, so the external end shield 74*e* is fixed. An attachment means between the external end shield 74*e* and movable electrode end plate 74 is not brazing; the external end shield 74*e* having a concave part 74*c*, which is concentric with the movable electrode end plate 74, and the movable electrode end plate 74 having a convex part 74*b* are mutually fitted and fixed. Accordingly, after the vacuum chamber 75 is formed by brazing the isolating cylinder 72, fixed electrode end plate 73, and movable electrode end plate 74, the stress relieving layer 72*a* covers the outer circumference of the isolating cylinder 72. After the stress relieving layer 72*a* has been formed up to the ends of the isolating cylinder 72, the external end shield 74*e* is provided.

The brazing part between the isolating cylinder 72 and movable electrode end plate 74 in this embodiment will be described again with reference to a magnified view (magnified view enclosed by a circle). The concave part 74*c* is formed on the external end shield 74*e* so as to face the convex part 74*b* formed on the movable electrode end plate 74. The distal end 74*a* of the external end shield 74*e* extends beyond the outer diameter of the isolating cylinder 72, with respect to the movable electrode end plate 74 disposed immediately below the isolating cylinder 72, and further extends beyond the stress relieving layer 72*a* disposed on the outer circumference of the isolating cylinder 72.

The detailed structure of the external end shield 74*e* will be described with reference to FIGS. 16 and 17.

Figure 16A:
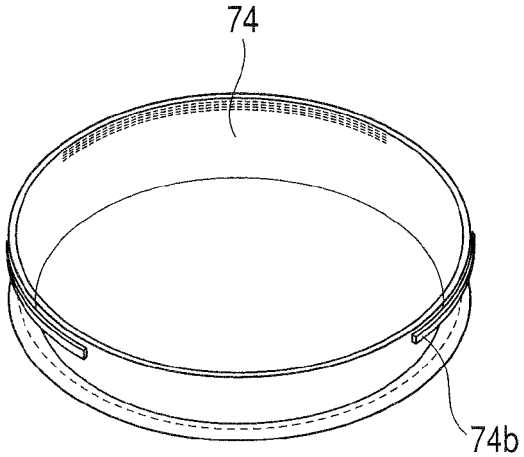
FIG. 16A is a perspective view of a concave part of an electrode end plate used in the vacuum switch of a ninth embodiment in the present invention.
Figure 16B:
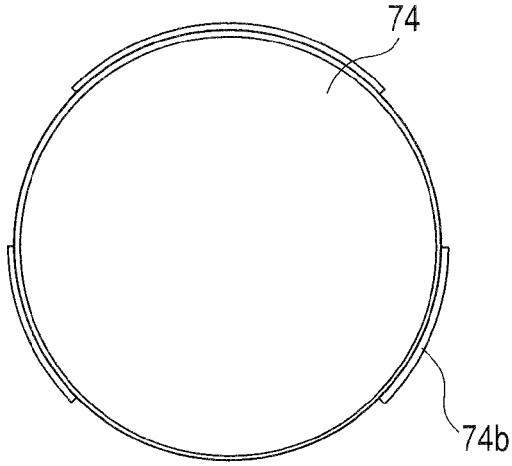
FIG. 16B is its plane view.

FIG. 16A is a perspective view of the concave part 74*b* of the electrode end plate 73, 74 described in the ninth embodiment, and FIG. 16B is its plane view.

Figure 17A:
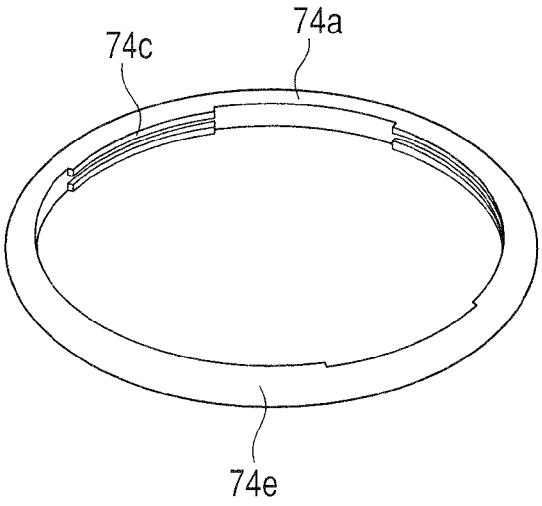
FIG. 17A is a perspective view of a convex part of an external end shield used in the vacuum switch of the ninth embodiment in the present invention.
Figure 17B:
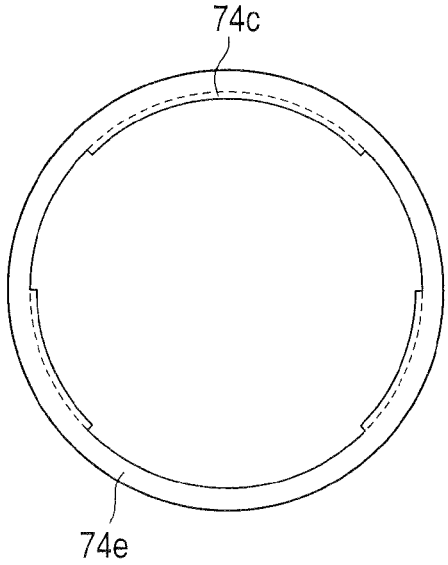
FIG. 17B is its plane view.

FIG. 17A is a perspective view of the convex part 74*c* of the external end shield 74*e* described in the ninth embodiment, and FIG. 17B is its plane view.

In FIGS. 16A, 16B, 17A, and 17B, the convex part 74*b*, shown in FIGS. 16A and 16B, of the movable electrode end plate 74 and the concave part 74*c*, shown in FIGS. 17A and 17B, of the external end shield 74*e* are manufactured by machining and/or casting.

A process of attaching the convex part 74*b* of the movable electrode end plate 74 and the concave part 74*c* of the external end shield 74*e* will be described below.

The external end shield 74*e* is positioned at the circumference at the bottom of the movable electrode end plate 74 so that the convex part 74*b* of the movable electrode end plate 74 and concave part 74*c* of the external end shield 74*e* are not aligned with each other. The external end shield 74*e* is slid on the outer wall of the electrode end plate 74 until the external end shield 74*e* touches the end of the isolating cylinder 72. Then, the external end shield 74*e* is turned, centered around the axial direction of the vacuum chamber 75, so that the concave part 74*c* of the external end shield 74*e* and the convex part 74*b* of the electrode end plate 74 are mutually mated. With the concave part 74*c* of the external end shield 74*e* and the convex part 74*b* of the electrode end plate 74 mutually mated, the entire vacuum chamber 75 is molded by the isolating layer 79 shown in FIG. 15.

Figure 20A:
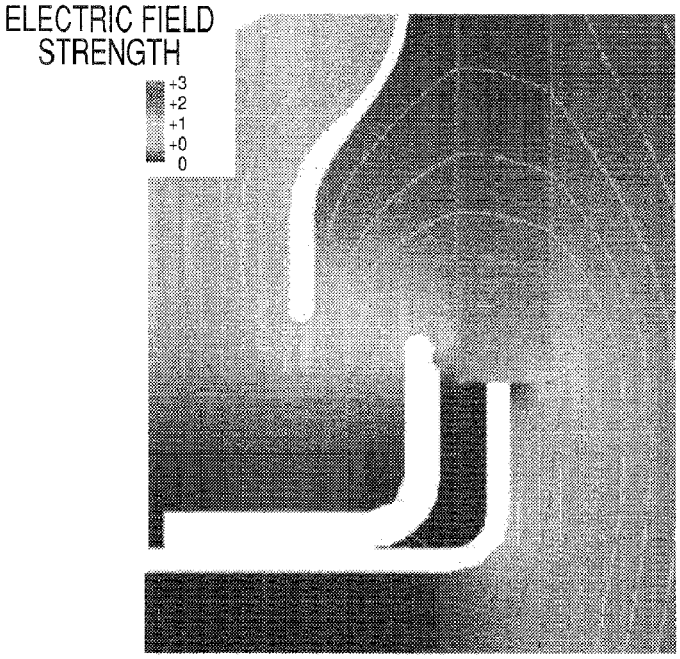
FIGS. 20A and 20B respectively show electric field strength in an ordinary mode and a mode in the embodiment of the present invention for comparison.
Figure 20B:
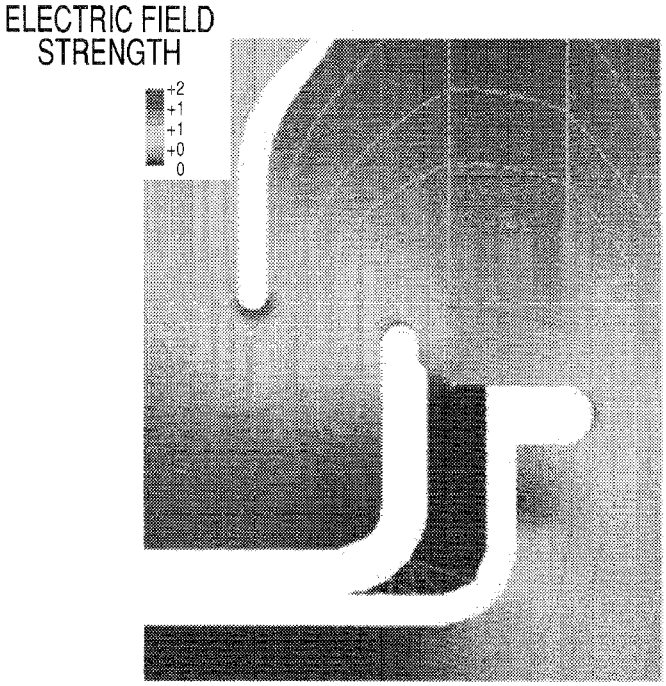

As for the shape of the external end shield 74*e* in FIGS. 17A and 17B, the external end shield 74*e* is provided along the curved surface of the external end. The distal end 74*a* of the external end shield 74*e* is positioned toward the isolating layer 79 beyond the external wall of the isolating cylinder 72. Accordingly, in the electric field strength of the electric field generated in the brazing parts between the ends of the isolating cylinder 72 and the electrode plates 74, as shown in FIGS. 20A and 20B, the peak value in electrode strength in FIG. 20B showing this embodiment in the present invention is lower than in a standard electric field shown in FIG. 20A, in which a conventional structure that lacks the external end shield 74*e* is used (an experimental result showed a 33% reduction).

Figure 18:
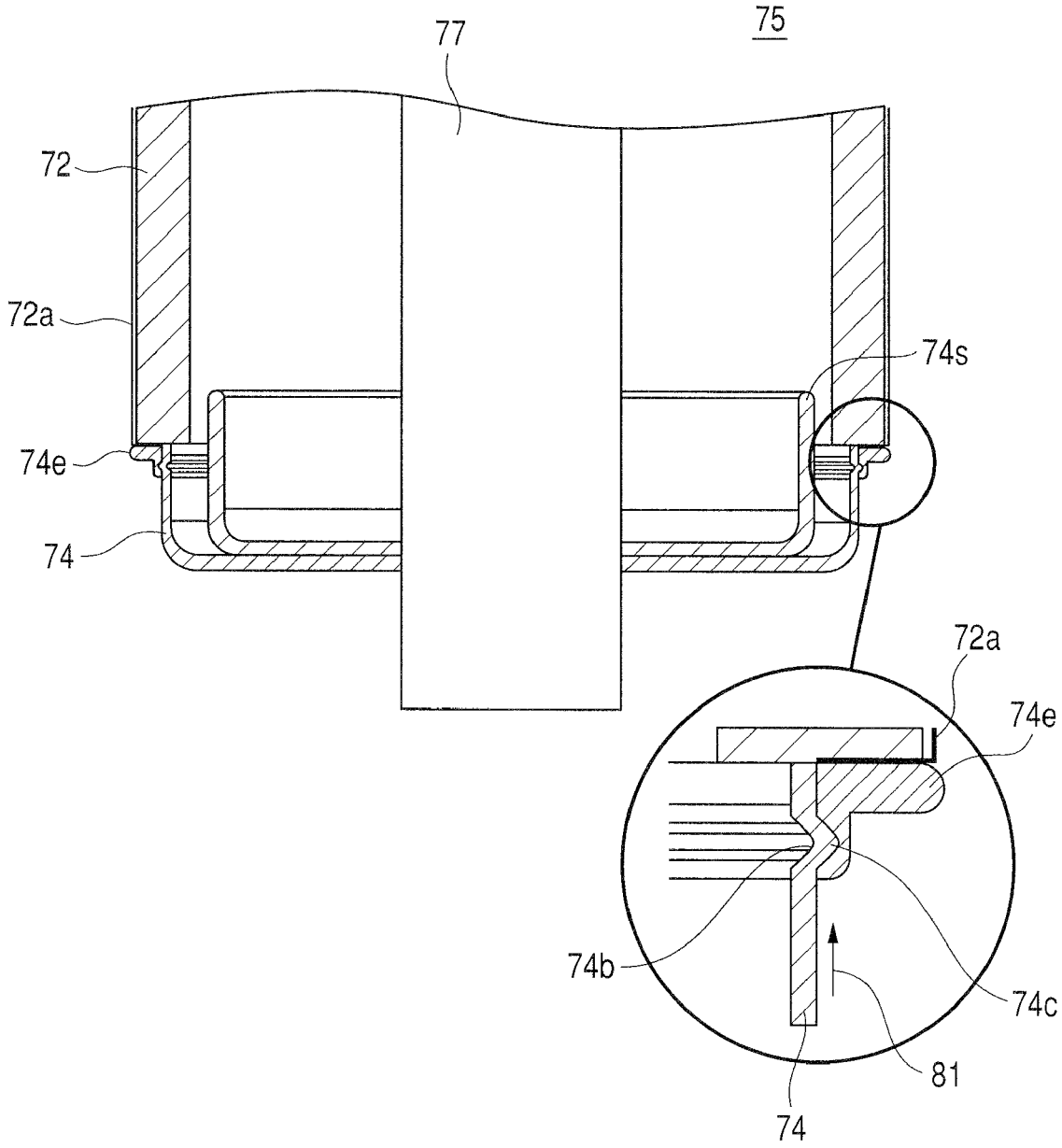
FIG. 18 is a cross sectional view of a vacuum switch of a vacuum switchgear showing a tenth embodiment in the present invention.

FIG. 18 is a partial cross sectional view of a vacuum switch of a vacuum switchgear to which a shield plate is attached, showing a tenth embodiment in the present invention.

In FIG. 18, on the outside of the vacuum chamber 75 as well, electric field relief is required in the brazing part between the isolating cylinder 72 and movable electrode end plate 74, as in the ninth embodiment. Accordingly, when the external end shield 74*e* is attached, an attachment means between the external end shield 74*e* and movable electrode end plate 74 is not brazing; the external end shield 74*e* having a concave part 74*c*, which is formed outside the end of the vacuum chamber 75 and is concentric with the movable electrode end plate 74, and the movable electrode end plate 74 having a convex part 74*b* are mutually fitted and fixed.

The convex part 74*b* of the movable electrode end plate 74 and the concave part 74*c* of the external end shield 74*e*, which are shown in the magnified view in FIG. 18, are manufactured through, for example, plastic forming. Although, in FIG. 17, the convex part 74*b* of the movable electrode end plate 74 is formed over 360° along the entire circumference, even if two or more convex parts 74*b* are formed, fixing is possible in this embodiment. In their attachment, elastic deformation due to R of the convex part 74*b* of the movable electrode end plate 74 and the concave part 74*c* of the external end shield 74*e* can be used. Accordingly, in this embodiment, the external end shield 74*e* is slid on the outer wall of the movable electrode end plate 74 in the direction 81 of insertion into the electrode end plate 74 until the external end shield 74*e* touches the end of the isolating cylinder 72, so that the concave part 74*c* of the external end shield 74*e* and the convex part 74*b* of the movable electrode end plate 74 are mutually mated.

Figure 19:
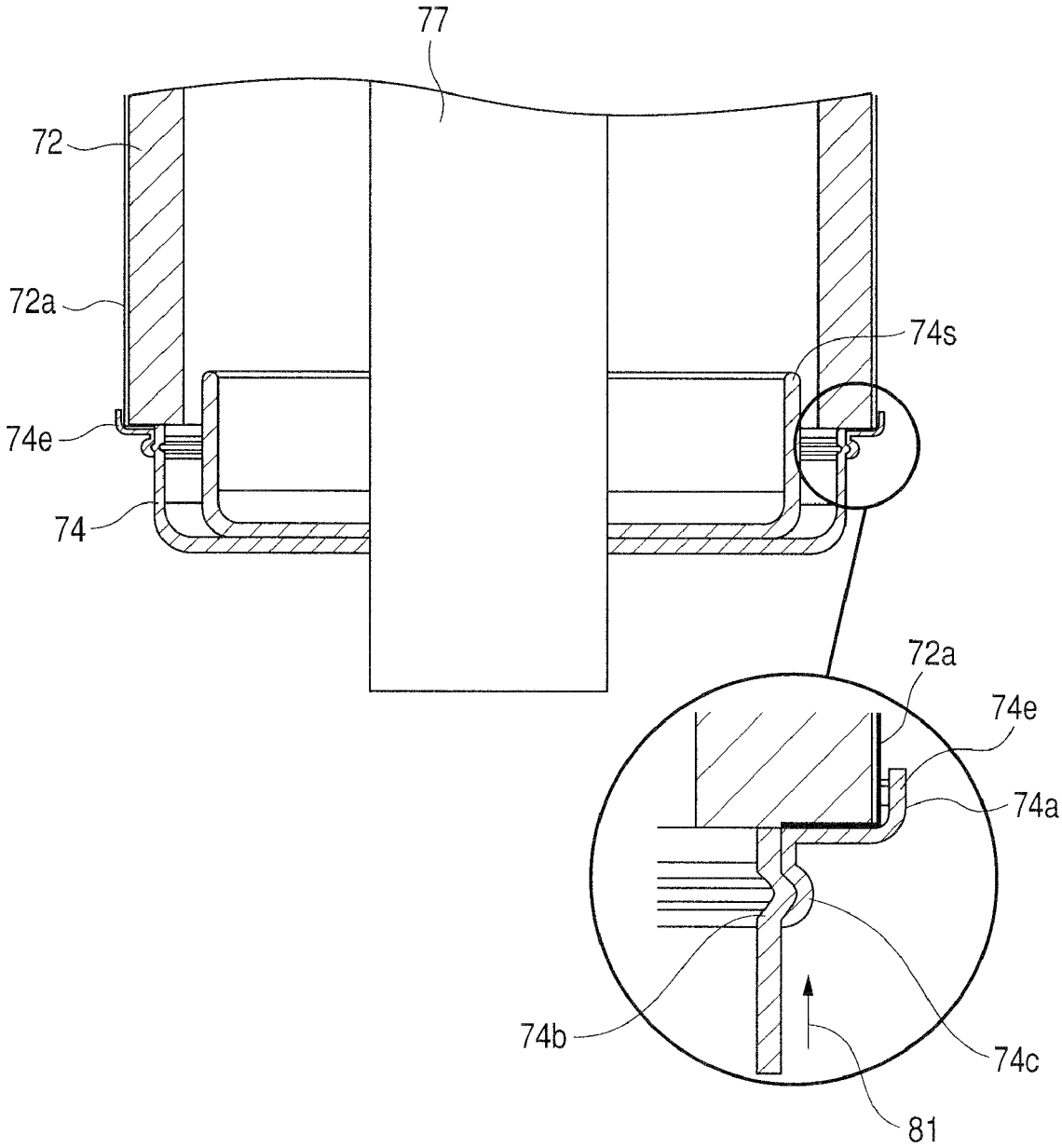
FIG. 19 is a cross sectional view of a vacuum switch of a vacuum switchgear showing an eleventh embodiment in the present invention.

FIG. 19 is a partial cross sectional view of a vacuum switch of a vacuum switchgear to which a shield plate is attached, showing an eleventh embodiment in the present invention.

In the eleventh embodiment in FIG. 19, the external end shield 74*e* is positioned so that it extends up to the outside of the vacuum chamber 75; the external end shield 74*e* is formed by a plate that is bent so as to cover the brazing part between the isolating cylinder 72 and external end shield 74*e*. The distal end 74*a* of the curvature part of the external end shield 74*e* is positioned from the end of the isolating cylinder 72 toward the center of the isolating cylinder 72. Since, as described above, the shield plate has a curvature part and is formed as a plate bent so as to cover the brazing part, significant electric field relief can be expected inside and outside the vacuum chamber 75.

Although the state of the convex part 74*b* of the movable electrode end plate 74 and the concave part 74*c* of the external end shield 74*e*, which are shown in the magnified view in FIG. 19, can be manufactured through, for example, plastic forming, the movable electrode end plate 74 has two or more convex parts. Their attachment is the same as in the tenth embodiment; the elastic effect of the state of the convex part 74*b* of the electrode end plate 74 and the state of the concave part 74*c* of the external end shield 74*e* is used. That is, the external end shield 74*e* is slid on the outer wall of the movable electrode end plate 74 in the direction 81 of insertion into the electrode end plate 74 until the external end shield 74*e* touches the end of the isolating cylinder 72, so that the concave part 74*c* of the external end shield 74*e* and the convex part 74*b* of the electrode end plate 74 are mutually mated.

The isolating layer 79, which is manufactured from resin or the like and has a prescribed thickness, is formed around the outer circumference of the vacuum chamber 75. Then, there is a risk that a clearance may be formed in the isolating layer 79, so it is difficult to use a complex shape such as convexes and concaves as the external shape of the vacuum chamber 75. If, however, a structure in which the bowl-shaped central shield 80 is used for electric field relief in the isolating layer 79, as an ordinary structure, there is a risk that a clearance may be generated when the isolating layer 79 is formed.

The three external end shields 74*e* shown in these embodiments each have a large curved surface at the distal end 74*a* of the external end shields 74*e* with the concave part 74*c*, and are positioned closer to the inside of the isolating layer 79 than the outer circumferential wall of the isolating cylinder 72. Accordingly, electric field relief can be expected without a complex structure having, for example, a large bend. Furthermore, since conductive paint is applied to the surface of the external end shield 74*e* and the surface of the movable electrode end plate 74, even if peeling occurs in the isolating layer and in the contact interface between the concave part 74*c* of the external end shield and movable electrode end plate 74, insulation performance can be ensured.

What is claimed is:

1. A vacuum switch having a fixed electrode, a movable electrode facing the fixed electrode, an insulating cylinder, end plates covering both axial ends of the insulating cylinder, a vacuum chamber internally accommodating the fixed electrode and the movable electrode, and a solid isolation resin molded on the outside of the vacuum chamber, comprises:

first coil springs, each of which is disposed around the outer circumference of one end plate while touching the end plate and an end face of the insulating cylinder, and second coil springs, each of which is united to one of the first springs and disposed around the outer circumference of the insulating cylinder so as to cover an the angular part of the end face of the insulating cylinder, wherein the end plates, the corresponding end faces of the insulating cylinder, and the corresponding, first and second coil springs are electrically connected.

2. The vacuum switch according to claim 1, wherein metalizing is applied to the end faces in the axial direction of the insulating cylinder, and the end plates, which are thinner than the insulating cylinder, are joined to the end faces of the insulating cylinder, the end faces being metalized.

3. The vacuum switch according to claim 1, wherein third coil springs, each of which is united to a respective one of the second coil springs, are disposed around the outer circumference of the insulating cylinder, and each of the third coil springs is electrically connected to the respective second coil spring.

4. The vacuum switch according to claim 3, wherein the circumferential length of each of the first coil spring is shorter than the circumferential lengths of each of the second and third coil springs.

5. The vacuum switch according to claim 1, wherein a concave part having an inward recess is formed near a brazing face of each of the end plates, on which the end plate is brazed to the insulating cylinder, and a corresponding one of the first coil springs is disposed in the concave part.

6. The vacuum switch according to claim 1, wherein a thin part, which is thinner than other parts, is formed near the insulating cylinder of each of the end plates, and a corresponding one of the first coil springs is disposed on the thin part of the end plate.

7. The vacuum switch according to claim 1, wherein a spring guide is disposed outside each of the end plates so that the spring guide does not overlap near the end face of the insulating cylinder but the spring guide overlaps at other parts, and a corresponding one of the first coil springs is fixed to the end plate that the spring guide does not overlap.

8. The vacuum switch according to claim 1, wherein each of the coil springs has the same circumferential length.

9. The vacuum switch according to claim 1, wherein each of the coil springs is formed in a doughnut shape by using a metal wire member that is wound in a spiral shape, the ends of each of the coil springs being united by a uniting line.

10. The vacuum switch according to claim 1, wherein each of the spring coils is formed in a doughnut shape by using a metal wire member that is wound in a spiral shape, the ends of each of the coil springs being joined by welding.

11. The vacuum switch according to claim 1, wherein each of the spring coils is formed in a doughnut shape by using a metal wire member that is wound in a spiral shape, the ends of each of the coil springs being united by hooks, and at least the first coil springs and the second coil springs are hooked at different positions.

12. A vacuum switchgear comprising:

the vacuum switch according to claim 1, an operating mechanism for operating the vacuum switch, a bus for supplying electric power to the vacuum switch, and an electric power cable connected to the vacuum switch, which supplies electric power to a load side.

13. The vacuum switchgear according to claim 12, wherein the vacuum switch has contacts between fixed electrodes and movable electrodes in a single vacuum chamber.

14. The vacuum switchgear according to claim 13, wherein the vacuum switch has a contact between a fixed electrode and a movable electrode in a different vacuum chamber.

* * * * *